US005778478A

United States Patent [19]

Coleman

[11] Patent Number: 5,778,478

[45] Date of Patent: Jul. 14, 1998

[54] TOOTHBRUSH WITH FLEXIBLE HANDLE

[76] Inventor: Brian V. Coleman, 5460 Autumnwood Dr., Cochranton, Pa. 16314

[21] Appl. No.: 873,887

[22] Filed: Jun. 12, 1997

[51] Int. Cl.[6] ..... A46B 9/04

[52] U.S. Cl. ..... 15/167.1; 15/143.1

[58] Field of Search ..... 15/143.1, 144.1, 15/167.1, 172, 176.1; D4/104, 112, 138

[56] References Cited

U.S. PATENT DOCUMENTS

| | | | |
|---|---|---|---|
| D. 142,917 | 11/1945 | Strieby | 15/143.1 X |
| 2,445,657 | 7/1948 | Bennett | 15/167.1 |
| 5,001,803 | 3/1991 | Discko, Jr. | 15/172 X |
| 5,150,495 | 9/1992 | Discko, Jr. et al. | 15/176.1 X |

FOREIGN PATENT DOCUMENTS

| | | | |
|---|---|---|---|
| 2185930 | 8/1987 | United Kingdom | 15/167.1 |
| 84-03209 | 8/1984 | WIPO | 15/167.1 |

*Primary Examiner*—Mark Spisich
*Attorney, Agent, or Firm*—H. Jay Spiegel

[57] ABSTRACT

A toothbrush includes a brush head having a pattern of bristles and a handle that consists of a soft, plastic, flexible, preferably transparent, tube with the brush head being fixedly mounted to the tube through insertion of a neck portion of the brush head within the passageway in the tube. Preferably, the tube and brush head are adhered together by an adhesive material. The inventive toothbrush is designed to be used particularly in the prison setting and the flexibility of the handle is designed to preclude its use as a weapon.

5 Claims, 1 Drawing Sheet

TOOTHBRUSH WITH FLEXIBLE HANDLE

BACKGROUND OF THE INVENTION

The present invention relates to a toothbrush with flexible handle. In the prison setting, inmates often fashion weapons out of various items to which they have access. In most prisons, the flooring is made of cement or concrete and provides a suitable surface for sharpening objects into knives and other dangerous weapons.

One such object consists of the ordinary one-piece plastic molded toothbrush that each inmate is given for toothbrushing. Inmates often sharpen the end of the toothbrush handle remote from the brush head into a sharp point and use the so created weapon against other inmates. As such, a need has developed, particularly in the prison setting, to eliminate the toothbrush as an object from which a weapon may be fashioned.

In the prior art, it is known to make a toothbrush of a brush head and a separate handle. Additionally, toothbrush handles including some degree of flexibility are known. However, Applicant is unaware of any toothbrush including all of the features and aspects of the present invention.

The following prior art is known to Applicant:

U.S. Pat. No. 2,883,691 to Gruenwald discloses a toothbrush having a head and a spring-like handle. The present invention differs from the teachings of Gruenwald as contemplating, for a handle, a flexible, soft, plastic tube.

U.S. Pat. No. 3,254,356 to Yao et al. discloses a combined toothbrush, tongue scraper and ear cleaner including a handle that may be flexed. The present invention differs from the teachings of Yao et al. as contemplating a handle that consists of a soft, flexible, plastic tube affixed to a separate brush head.

U.S. Pat. No. 4,227,276 to Ginsburg et al. discloses a toothbrush with thermally deformable handle with the handle being separate from the head. The present invention differs from the teachings of Ginsburg et al. as contemplating a handle that is continually flexible, not just during a narrow temperature range, and as contemplating rigidly affixing the brush head thereof to the handle.

U.S. Pat. No. 4,829,621 to Phenegar discloses a toothbrush having a handle with an elastically deformable neck section allowing the brush head to be positioned at varying angular orientations relative to the handle. In Phenegar, the body of the handle is rigid. The present invention differs from the teachings of Phenegar as contemplating a handle made of a soft, flexible, plastic tube.

SUMMARY OF THE INVENTION

The present invention relates to a toothbrush with flexible handle. The present invention includes the following interrelated objects, aspects and features:

(1) In a first aspect, the inventive toothbrush includes a brush head having a pattern of bristles thereon. The brush head has a neck portion provided for a purpose to be described in greater detail hereinafter.

(2) The handle of the toothbrush consists of a flexible, plastic tube, preferably transparent, that is affixed to the brush head at the neck portion thereof. Any suitable adhesive may be employed to permanently affix the tube to the brush head.

(3) The material of the tube is chosen so that it may not be sharpened into a weapon as would be the case with the rigid, plastic handles on typical toothbrushes.

Accordingly, it is a first object of the present invention to provide a toothbrush with flexible handle.

It is a further object of the present invention to provide such a device with a brush head having a pattern of bristles thereon as well as a neck portion.

It is a still further object of the present invention to provide such a device wherein the handle thereof is made of a transparent, flexible, plastic tube.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
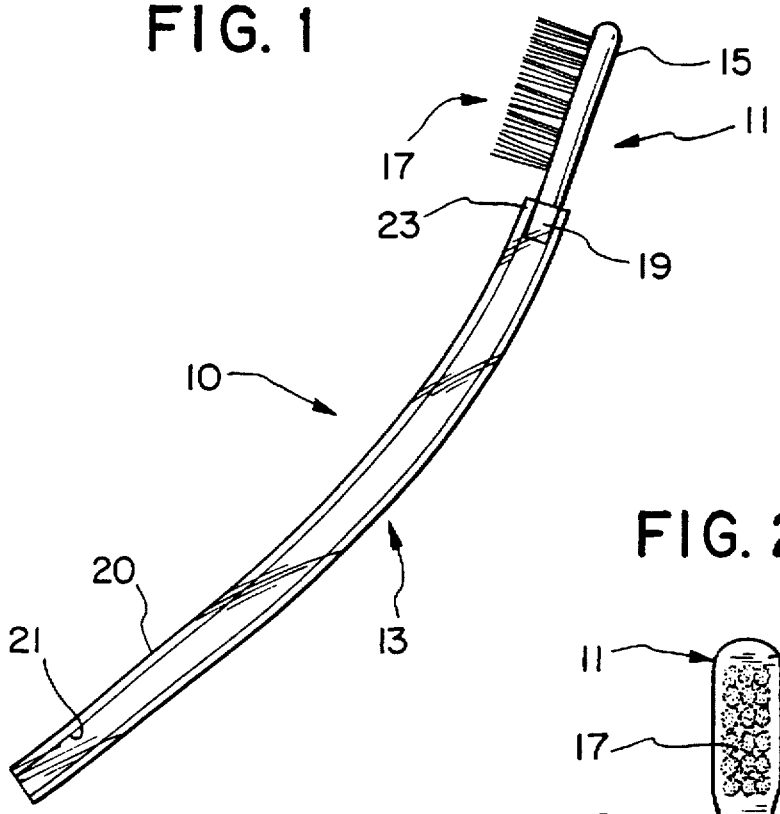
FIG. 1 shows a side view of the present invention.
Figure 2:
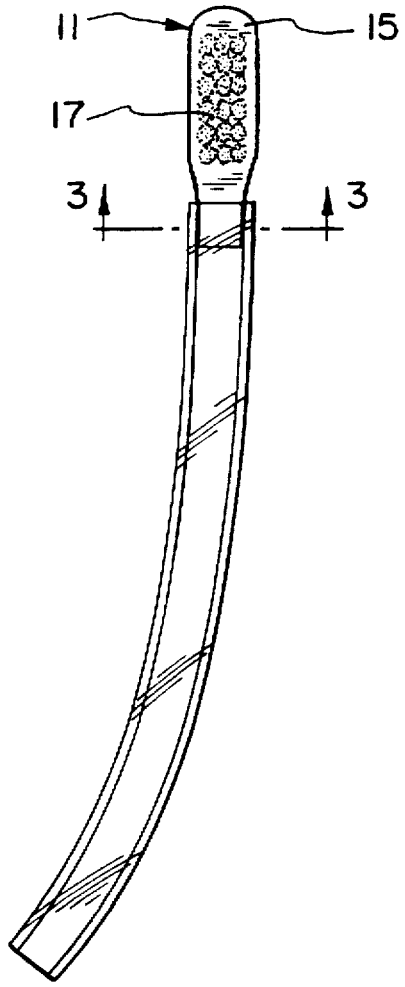
FIG. 2 shows a top view of the present invention.

With reference, first, to FIG. 1, the present invention is generally designated by the reference numeral 10 and is seen to include a brush head 11 and a handle 13. The brush head 11 includes a base 15 on which is mounted a pattern of bristles 17 consisting of a multiplicity of individual bristles arranged in a pattern thereon. Any suitable pattern for the bristles may be employed. The brush head 11 also includes a neck portion 19 integrally connected to the base 15.

The handle 13 preferably consists of a flexible, plastic tube 20 having a passageway 21 therethrough. If desired, the tube 20 may be made of a transparent, plastic material. Of course, if desired, the tube 20 may be made of any desired color. The plastic material for the tube 20 is a soft plastic that allows a great degree of flexibility of the tube 20 so that the tube 20 may not be fashioned into a sharp edged weapon.

Figure 3:
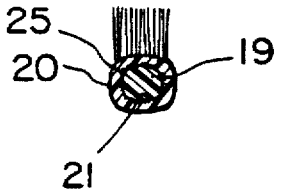
FIG. 3 shows a cross-sectional view along the line 3—3 of FIG. 2.

The tube 20 has a distal end 23 that is stretched over the neck portion 19 of the brush head 11. FIG. 3 shows the neck portion 19 within the passageway 21 of the tube 20 and also shows the deformation of the normally cylindrical tube 20 to accommodate to the more elongated cross-section of the neck portion 19. Suitable adhesive 25 is applied between the neck portion 19 and the tube 20 to formally adhere the brush head 11 to the handle 13. The proximal end of the tube may, if desired, be sealed with a suitable plug (not shown) mounted in place with adhesive or by seal means such as, for example, silicone sealer inserted therein in a soft state and cured by exposure to air.

If desired, the cross-section of the neck portion 19 of the brush head 11 may be made of any suitable shape. For example, the said cross-section may be made circular. If such is the case, it is preferred that the diameter of the circular neck portion be made greater than the diameter of the passageway 21 through the tube 20 so that slight stretching of the tube 20 is necessary to insert the neck portion 19 into the passageway 21 thereof.

In the preferred embodiment of the present invention, the brush head 11 may be made of any suitable material such as, for example, injection molded plastic and the bristles 17 may be made of any suitable and desirable bristle material such as NYLON, plastic or the like.

Accordingly, an invention has been disclosed in terms of a preferred embodiment thereof which fulfills each and every one of the objects of the invention as set forth hereinabove and provides a new and useful toothbrush with flexible handle of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. An improved toothbrush for use in a prison, comprising:

a) a brush head including a base, a neck portion attached to said base and extending from said base in a substantially common plane therewith, and a plurality of bristles extending from said base generally perpendicular to said plane;

b) a handle comprising an elongated flexible transparent tube having a passageway therethrough, said passageway defined by an interior wall of said tube;

c) said neck portion being received within an end of said passageway and engaging said interior wall to connect said brush head to said handle, a remainder of said passageway being visibly empty.

2. The toothbrush of claim 1, wherein said neck portion has a generally flat cross-section.

3. The toothbrush of claim 1, wherein said tube is made of plastic.

4. The toothbrush of claim 1, wherein said brush head is fixedly mounted on said handle with adhesive.

5. The toothbrush of claim 4, wherein said neck portion is adhered within said passageway.

* * * * *